US009380875B2

(12) United States Patent
Caldwell

(10) Patent No.: US 9,380,875 B2
(45) Date of Patent: Jul. 5, 2016

(54) METHODS AND APPARATUS FOR SUPPORT CHANNEL

(71) Applicant: International Technical Coatings, Inc., Phoenix, AZ (US)

(72) Inventor: Johnnie Caldwell, Paradise Valey, AZ (US)

(73) Assignee: International Technical Coatings, Inc., Phoenix, AZ (US)

( * ) Notice: Subject to any disclaimer, the term of this patent is extended or adjusted under 35 U.S.C. 154(b) by 0 days.

(21) Appl. No.: 14/486,615

(22) Filed: Sep. 15, 2014

(65) Prior Publication Data

US 2015/0076098 A1 Mar. 19, 2015

Related U.S. Application Data

(60) Provisional application No. 61/877,887, filed on Sep. 13, 2013.

(51) Int. Cl.
*A47F 5/00* (2006.01)
*A47B 96/02* (2006.01)

(52) U.S. Cl.
CPC ..... *A47B 96/021* (2013.01)

(58) Field of Classification Search
CPC ..... A47B 96/14; A47B 96/021
USPC ..... 211/183, 190; 52/220, 220.4, 845, 852

See application file for complete search history.

(56) References Cited

U.S. PATENT DOCUMENTS

| | | | | | |
|---|---|---|---|---|---|
| 2,391,997 | A * | 1/1946 | Noble | 52/578 | |
| 3,349,924 | A * | 10/1967 | Maurer et al. | 211/41.1 | |
| 4,630,414 | A * | 12/1986 | Ting | 52/220.4 | |
| 4,663,894 | A * | 5/1987 | LaRoche et al. | 52/15 | |
| 4,845,908 | A * | 7/1989 | Stohs | 174/486 | |
| 5,765,328 | A * | 6/1998 | Moore | 52/302.1 | |
| 6,065,266 | A * | 5/2000 | Behr et al. | 52/630 | |
| 6,401,944 | B1 * | 6/2002 | Kircher et al. | 211/134 | |
| 6,668,513 | B2 * | 12/2003 | Roberts | B62D 25/145 | 296/205 |
| 6,681,942 | B2 * | 1/2004 | Haney | 211/183 | |
| 6,755,596 | B2 * | 6/2004 | Schibi | 405/270 | |
| 7,571,580 | B2 * | 8/2009 | Miller | 52/650.3 | |
| 7,736,092 | B2 * | 6/2010 | Hodgekins et al. | 405/119 | |

* cited by examiner

*Primary Examiner* — Basil Katcheves
(74) *Attorney, Agent, or Firm* — The Noblitt Group, PLLC

(57) ABSTRACT

Methods and apparatus for a support channel according to various aspects of the present technology comprise a support channel having a strengthening ridge positioned along a closed end of an open channel body. The ridge may extend along the length of the channel body to increase a load bearing capacity of the channel body as compared to a similar shaped body without the ridge. The ridge may comprise a rounded protrusion extending outward from the dosed end of the channel, body in a manner that provides additional resistance to loading forces.

5 Claims, 4 Drawing Sheets

METHODS AND APPARATUS FOR SUPPORT CHANNEL

CROSS-REFERENCES TO RELATED APPLICATIONS

This application claims the benefit of U.S. Provisional Patent Application No. 61/877,887, filed Sep. 13, 2013, and incorporates the disclosure of the application by reference.

BACKGROUND OF INVENTION

Shelving and rack storage systems often provide storage space in bays positioned between vertical members. Shelves or racks may be positioned within a bay to facilitate the storage of items. Shelves and racks may be modular or otherwise designed for nonpermanent placement within a bay so that storage space may be configured and reconfigured to account for changing conditions, such as the amount of storage space required at any given time or to account for various sized packages, boxes, and articles to be stored. Modular racks and shelves are therefore often lightweight to allow for easier placement. However, strength of a shelf may be sacrificed as weight is removed.

Horizontal support structures that span the distance between vertical members are used to provide increased load bearing capacity to shelves or racks positioned within a bay. The support structures come in many forms such as tubes, channels, I-beams, and the like. As with shelves, strength of a support structure may be sacrificed as weight is removed.

SUMMARY OF THE INVENTION

Methods and apparatus for a support channel according to various aspects of the present technology comprise a support channel having a strengthening ridge positioned along a closed end of an open channel body. The ridge may extend along the length of the channel body to increase a load bearing capacity of the channel body as compared to a similar shaped body without the ridge. The ridge may comprise a rounded protrusion extending outward from the closed end of the channel body in a manner that provides additional resistance to loading forces.

BRIEF DESCRIPTION OF THE DRAWINGS

A more complete understanding of the present technology may be derived by referring to the detailed description when considered in connection with the following illustrative figures. In the following figures, like reference numbers refer to similar elements and steps throughout the figures.

DETAILED DESCRIPTION OF EXEMPLARY EMBODIMENTS

The present technology may be described in terms of functional block components and various processing steps. Such functional blocks may be realized by any number of components configured to perform the specified functions and achieve the various results. For example, the present invention may employ various types of materials, shelves, rails and the like, which may carry out a variety of functions. In addition, the present technology may be practiced in conjunction with any number of systems, such as shelving systems, display racks, and support systems, and the system described is merely one exemplary application for the technology. Further, the present technology may employ any number of conventional techniques for metalworking, component manufacturing, tooling fabrication, and/or forming surfaces.

Methods and apparatus for a support channel according to various aspects of the present technology may operate in conjunction with any suitable shelving, storage, or display system. Various representative implementations of the present technology may also be applied to any system requiring structural support for various types of loads.

Figure 1:
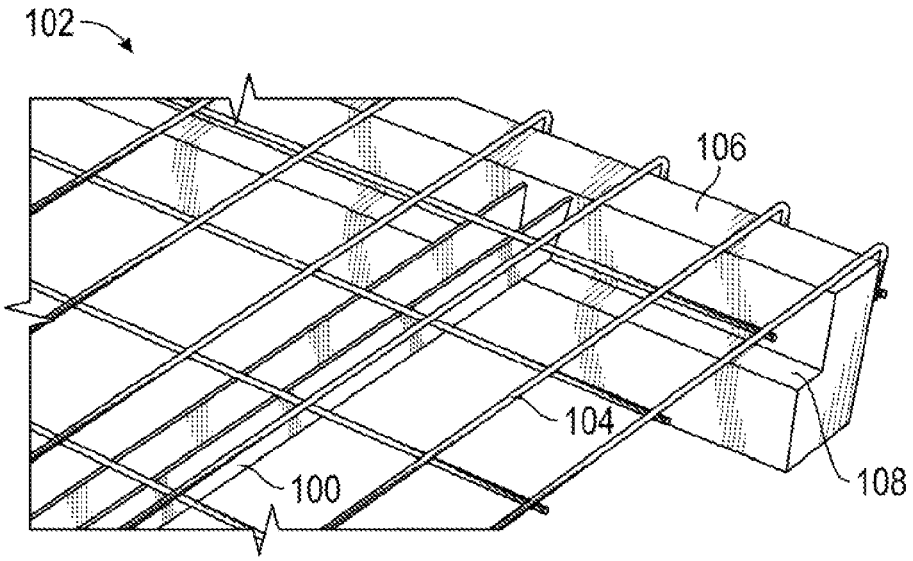
FIG. 1 representatively illustrates a perspective view of a decking system accordance with an exemplary embodiment of the present invention.

Referring now to FIG. 1, in an exemplary embodiment of the present technology a support channel 100 may be used to provide structural support to a decking system 102 to increase an overall load bearing capability of the decking system 102. For example, the support channel 100 may comprise one or more structural members coupled to an under side of a mesh deck 104 to allow an end of the decking system 102 to be positioned on a support rail 106 such that objects may be placed on a top side of the mesh deck 104.

The support channel 100 may comprise any suitable system for providing structural support or allowing for an increased load bearing capacity of the mesh deck 104. For example, referring now to FIG. 2, the support channel 100 may comprise a ridge 204 extending between a first end 206 and a second end 208 of the support channel 100. A pair of opposing sidewalls 202 may extend generally upwardly away from the ride 204. The support channel 100 may comprise any suitable material, such as hot or cold rolled steel, stainless steel, iron, aluminum, and/or any suitable plastic, composite, or alloy. For example, in one embodiment, the support channel 100 may comprise a grade 50-65. steel having a thickness of between one thirty-second of an inch and three sixteenths of an inch.

The support channel 100 may comprise any suitable shape or dimension which may be determined according to a desired application. For example, referring now to FIGS. 2 and 3, the support channel 100 may comprise a generally "U" shaped channel body wherein the pair of opposing sidewalls 202 are separated from each other by a gap and are substantially parallel to each other along at least a portion of a height "H" of the sidewalls 202. In one embodiment, a first transition element 102 of one of the pair of sidewalls 202 may form a curved surface that extends upwardly away from a first inflection point 314 of the ridge 204 and a center portion of the gap before thrilling or otherwise engaging a vertical surface of a first straight sidewall element 304 at a first transition point 316. The first straight sidewall element 304 may extend from the first transition point 316 to a terminating first end portion 320 of one of the sidewall 202. The first straight sidewall element 304 may be substantially parallel to an opposing second straight sidewall element 308.

Similarly, a second transition element 306 may form a curved surface that extends upwardly away from a second inflection point 312 of the ridge 204 and the center portion of the gap before forming or otherwise engaging the second straight sidewall element 308 at a second transition point 318. The second straight sidewall element 308 may extend from the second transition point 318 to a terminating second end portion 22 of one of the other sidewall 202. The first and second transition elements 302, 306 may be formed as substantially mirror images such that the curved surfaces each form a concave surface relative to an inner portion of the support channel 100 or gap.

Figure 4:
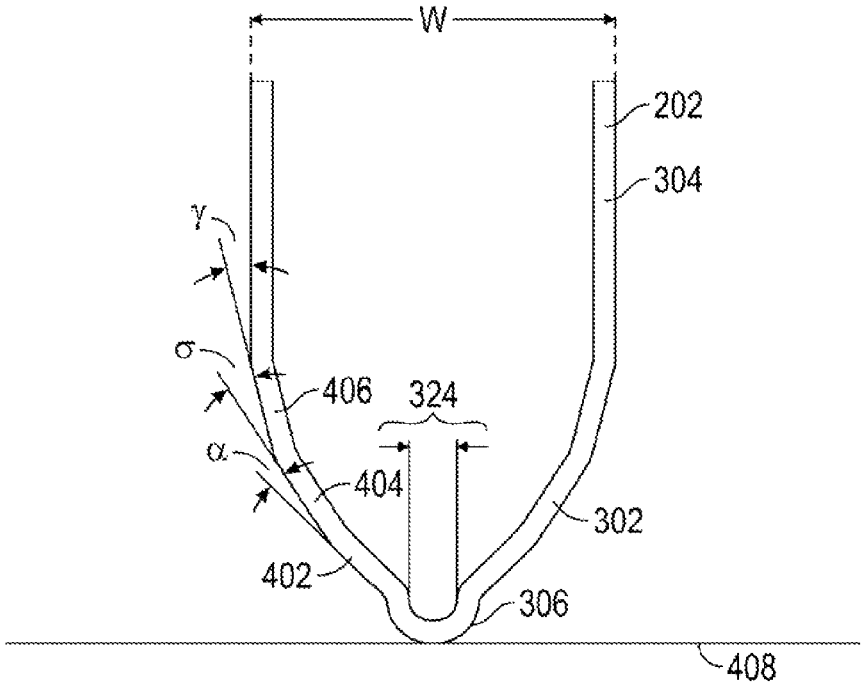
FIG. 4 representatively illustrates an end view of an alternative support channel in accordance with an exemplary embodiment of the present invention.

Referring now to FIG. 4, in a second embodiment, the first and second transition elements 302, 306 of each sidewall 202 may comprise one or more substantially linear wall segments. For example, each wall segment may depend from a horizontal axis 408 by an increasingly larger amount until meeting the first and second straight sidewall elements 304, 308 of the sidewalls 202 and thereby becoming substantially perpendicular to the horizontal axis 408. In one embodiment, a first wall segment 402 may depend from the horizontal axis 408 by an angle "α" of between about 15-45°, a second wall segment 404 may depend from the axis 408 by an angle "σ" of between about 30-60°, and a third wall segment 406 may depend from the horizontal axis 408 by an angle "γ" of between about 55-85°. In a second embodiment, the first wall segment 402 may depend from the horizontal axis 408 by an angle of about 42°, the second wall segment 404 may depend from the horizontal axis 408 by an angle of about 57°, and the third wall segment 406 may depend from the horizontal axis 408 by an angle of about 72°. In a third embodiment, the first and second transition elements 302, 306 may comprise between two and six segments wherein each segment comprises any suitable angle relative to the horizontal axis 408.

The sidewalls 202 may comprise any suitable dimensions and may be determined according to a desired application or load bearing requirements. In one embodiment, the height "H" of the sidewalls 202 in comprise as value of between about one inch and four inches. A higher value for "H" may be selected to account for increased load bearing requirements. For example, as the height "H" of the sidewalls 202 is increased the channel 100 may have an increased load carrying capacity.

Similarly, a channel width "W" of the gap between the sidewalk 202 may be determined according to any suitable criteria such as loading requirements or a dimensional pattern of the mesh deck 104. For example, in one embodiment, the sidewalls may comprise a channel width of between about one-quarter of an inch to about two inches.

Figure 2:
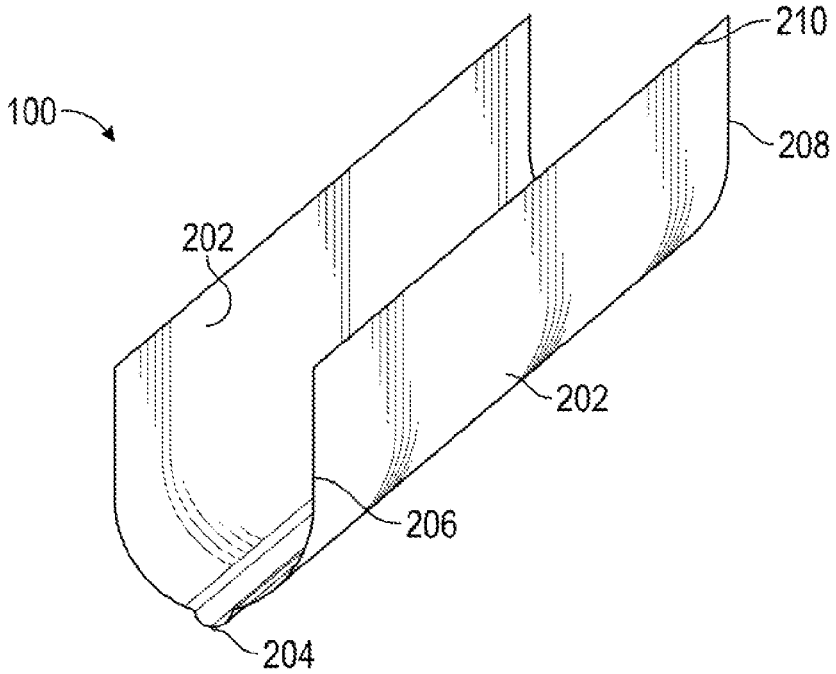
FIG. 2 representatively illustrates a perspective view of a support channel in accordance with an exemplary embodiment of the present invention.
Figure 3:
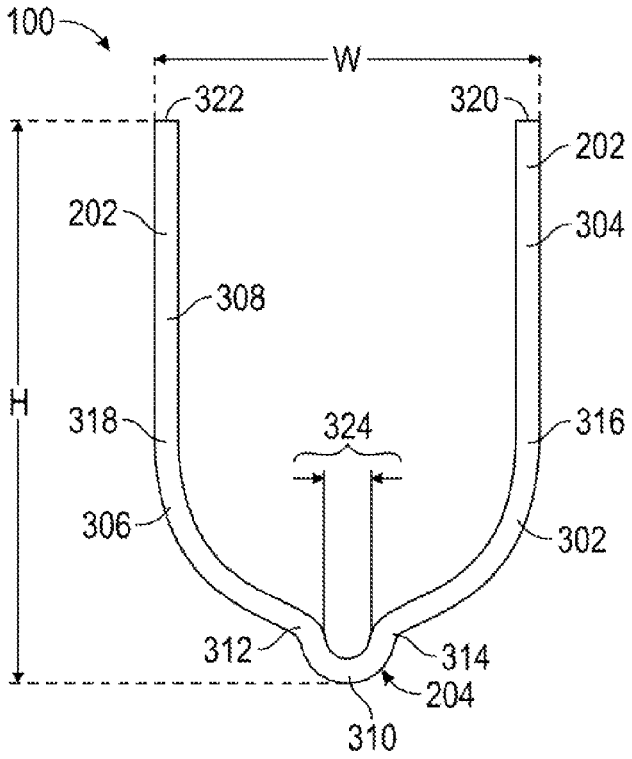
FIG. 3 representatively illustrates an end view of the support channel in accordance with an exemplary embodiment of the present invention.
Figure 5:
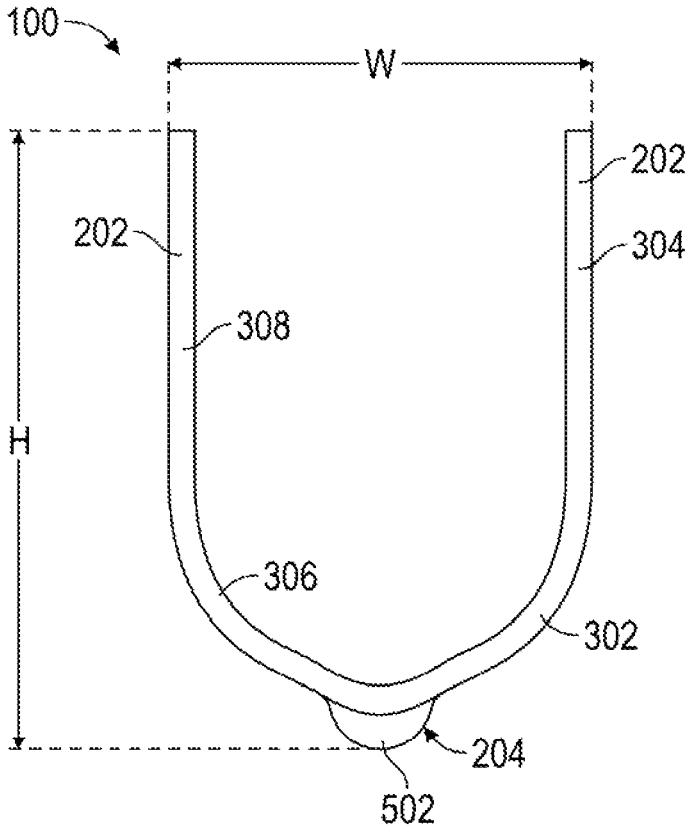
FIG. 5 representatively illustrates an end view of a support channel having a rib in accordance with an exemplary embodiment of the present invention.
Figure 6:
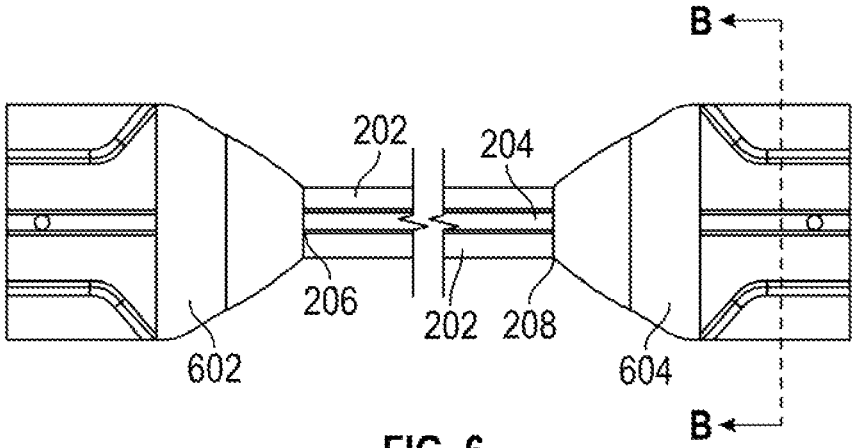
FIG. 6 representatively illustrates a top view of the support channel having flanged end portions in accordance with an exemplary embodiment of the present invention.
Figure 7:
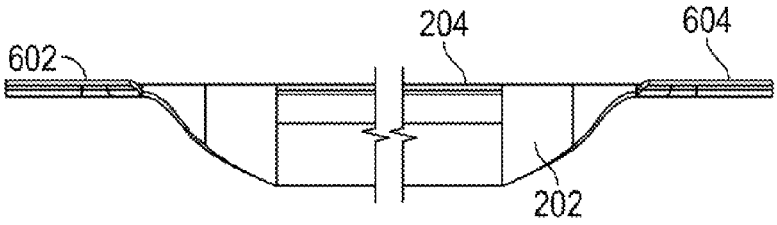
FIG. 7 representatively illustrates an end view of the support channel having flanged end portions in accordance with an exemplary embodiment of the present invention.
Figure 8:
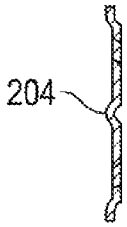
FIG. 8 representatively illustrates a cross sectional view of the support channel across line B-B of FIG. 6.

The ridge 204 increases an overall load bearing strength of the channel 100 and may comprise and suitable device or method for increasing the load bearing capacity of the channel 100. For example, as shown in FIG. 2, the ridge 204 may comprise a protrusion 310 extending downwardly away from the first and second transition elements 302, 306 of the sidewalls 202. The protrusion 310 may help increase an overall height of the sidewalls 202 resulting in an increased load bearing capacity of the support channel 100. In a second embodiment, the protrusion 310 may extend upwardly between the sidewalls 202. In a third embodiment, additional protrusions may be added to the sidewalls 202 to provide additional strength to the support channel 100. For example, an additional protrusion may be added between each wall segment 404, 406 and disposed between the protrusion 310 and first and second straight sidewall elements 304, 308. Referring now to FIG. 5, in a fourth embodiment, the ridge 204 may comprise a rib 502 configured to be welded to a lower most surface of the support channel 100 between the sidewalls 202 to extend along the length of the support channel 100 between the first end 206 and the second end 208.

Figure 9:
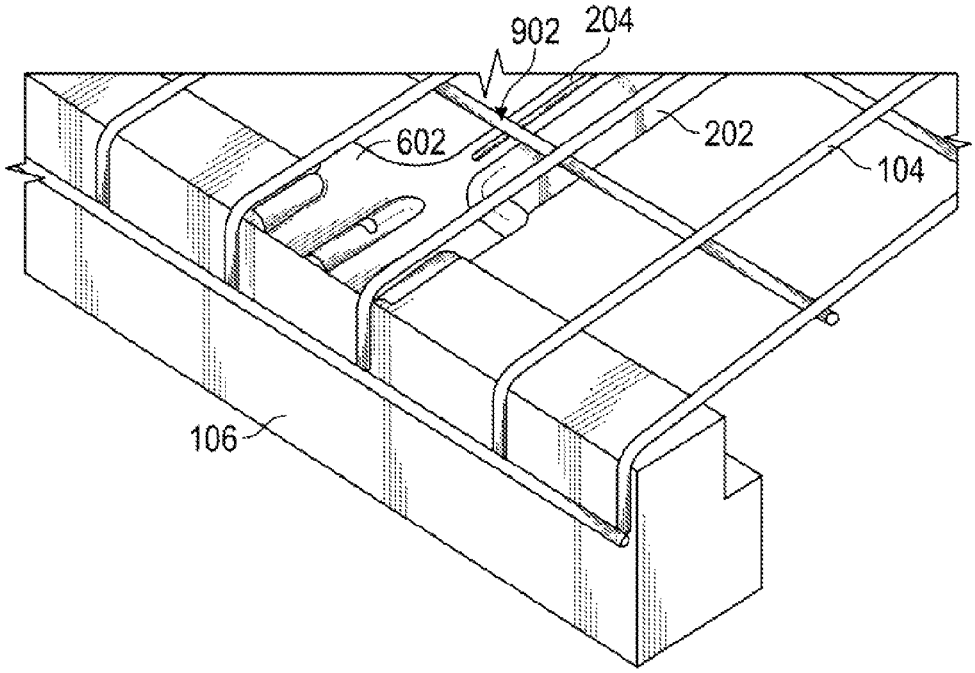
FIG. 9 representatively illustrates a decking system using the support channel with flanged end portions in accordance with an exemplary embodiment of the present invention.

The ridge 204 may comprise any suitable shape or size and may be determined, at least in part, by a desired overall dimension of the support channel 100. For example, the ridge 204 may comprise a substantially rounded surface having an inner diameter 324 of between one thirty-seconds of an inch and one-quarter of an inch. Referring now to FIG. 9, in one embodiment, the dimensions of an outer surface of the ridge 204 may be determined according to a wire size of the mesh deck 104 such that the ridge 204 provides an increased surface area for welding the ridge 204 to the mesh deck 104 at points of intersection 902.

The first end 206 and the second end 208 of the support channel 100 may be configured to be coupled to the rail 106 by any suitable method. For example, referring again to FIG. 1, in one embodiment, the first end 206 and the second end 208 may comprise a substantially straight edge that is suitably configured to be positioned along a ledge 108 of the rail. Referring now to FIGS. 6-9, in a second embodiment, the first end 206 and the second end 208 of the support channel 100 may be stamped flat to form a first flange 602 on the first end 206 and a second flange 604 on the second end 208.

The support channel 100 may be formed by any suitable method or manufacturing process. For example, in one embodiment, the support channel 100 may be formed from a single piece of hot rolled steel. In a first step, a substantially rectangular piece of steel of about three inches in width and about forty-eight inches in length may be roll formed to create a curved ridge 204 extending along the length of the piece of steel. The rib may comprise an inner radius of about one sixteenth of an inch. A second roll forming step may then bond the piece of steel along its length to form a pair of parallel sidewalk 202. The support channel 100 may be then spot welded to a mesh deck 104 to form a completed decking system 102.

The particular implementations shown and described are illustrative of the invention and its best mode and are not intended to otherwise limit the scope of the present invention in any way. Indeed, for the sake of brevity, conventional manufacturing, connection, preparation, and other functional aspects of the system may not be described in detail. Furthermore, the connecting lines shown in the various figures are intended to represent exemplary functional relationships and/or steps between the various elements. Many alternative or additional functional relationships or physical connections may be present in a practical system.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. A support channel, comprising:

a channel body having a first end and a second end, wherein the channel body comprises:

a pair of opposing straight sidewall elements extending between the first and second ends, wherein:

the sidewall elements are separated by a gap defining a channel width; and each sidewall element comprises a terminating end portion and a transition point;

a first transition element extending from the transition point of one of the sidewall elements towards a first inflection point proximate a center of the gap;

a second transition element extending from the transition point of the remaining sidewall element towards a second inflection point proximate the center of the gap; and a ridge positioned at the center of the gap and extending between the first inflection point and the second inflection point, wherein the ridge:

comprises a protrusion extending downwardly beyond the first and second inflection points; and extends along a length of the channel body between the first and second ends; and a first flange disposed at the first end proximate the ridge and a second flange disposed at the second end proximate the ridge, wherein each flange comprises a substantially flat surface extending outwardly from the ridge.

2. A support channel according to claim 1, wherein the ridge comprise a substantially rounded surface having an inner diameter of between one thirty-seconds of an inch and one-quarter of an inch.

3. A support channel according to claim 1, wherein the first and second transition elements are curved concave relative to the center of gap to form a substantially u-shaped channel body.

4. A support channel according to claim 1, wherein the first and second transition elements each comprise:

a first substantially linear wall segment extending from the ridge towards one of the sidewall elements, wherein the first substantially linear wall segment comprises a first angle relative to a horizontal axis of the support channel; and a second substantially linear wall segment extending from the first substantially linear wall segment towards one of the sidewall elements, wherein:

the second substantially linear wall segment comprises a second angle relative to a horizontal axis of the support channel; and the second angle is larger than the first angle.

5. A support channel according to claim 1, wherein the pair of opposing straight sidewall elements are parallel to each other between the first end and the second end of the channel body.

* * * * *